US007770695B2

(12) United States Patent
Myers

(10) Patent No.: US 7,770,695 B2
(45) Date of Patent: Aug. 10, 2010

(54) VEHICLE LIFT DEVICE INCLUDING SCISSOR LIFT AND TELESCOPIC UPPER PLATFORM

(75) Inventor: James W. Myers, Gainesville, VA (US)

(73) Assignee: Harding Steel, Inc., Denver, CO (US)

( * ) Notice: Subject to any disclaimer, the term of this patent is extended or adjusted under 35 U.S.C. 154(b) by 552 days.

(21) Appl. No.: 11/843,118

(22) Filed: Aug. 22, 2007

(65) Prior Publication Data

US 2009/0053024 A1 Feb. 26, 2009

(51) Int. Cl.
*B66F 7/16* (2006.01)

(52) U.S. Cl. ..... 187/215; 187/211; 187/213; 187/221; 414/227; 414/611

(58) Field of Classification Search ..... 414/227, 414/611; 187/211, 213, 215, 221
See application file for complete search history.

(56) References Cited

U.S. PATENT DOCUMENTS

| | | | | |
|---|---|---|---|---|
| 1,931,402 | A | | 10/1933 | Black |
| 4,594,044 | A | * | 6/1986 | Soot ..... 414/263 |
| 4,674,938 | A | | 6/1987 | Van Stokes et al. |
| 5,018,925 | A | | 5/1991 | Ganser |
| 5,024,571 | A | | 6/1991 | Shahar et al. |
| 5,035,562 | A | | 7/1991 | Rosen |
| 5,129,776 | A | | 7/1992 | Peng |
| 5,335,755 | A | | 8/1994 | Miller |
| 5,456,562 | A | | 10/1995 | Schlecker et al. |
| 5,497,854 | A | * | 3/1996 | Fang ..... 187/213 |
| 6,077,017 | A | | 6/2000 | Durant |
| 6,241,049 | B1 | | 6/2001 | Gooch |

(Continued)

FOREIGN PATENT DOCUMENTS

| | | |
|---|---|---|
| EP | 220594 | 5/1987 |

(Continued)

OTHER PUBLICATIONS

Applicant Prior Art Publication: "Carparx Model ST-2 Inground Parking System Description", Harding Steel, Inc., Copyright 2005, p. 1-5.

(Continued)

*Primary Examiner*—Michael S Lowe
(74) *Attorney, Agent, or Firm*—Sheridan Ross PC

(57) ABSTRACT

A vehicle lift device and method are provided wherein the lift device has upper and lower platforms that may receive vehicles for parking or storage. The lower platform may be selectively raised or lowered between two levels of a parking structure. The upper platform is mounted on telescoping supports. When the car lift device is raised to place the lower platform at the upper level of the parking structure, the telescoping posts retract allowing the upper platform to lower, thereby providing clearance between the upper platform and a ceiling of the parking structure. The posts retract by the weight of the upper platform, and no hydraulic assist is required. When the lift device is lowered to place the lower platform at the lower level of the parking structure, the upper platform engages the floor of the upper level of the parking structure and thereby covers the opening in the floor. The telescoping posts then extend as the lower platform travels to its lowered position at the lower level.

15 Claims, 7 Drawing Sheets

U.S. PATENT DOCUMENTS

| | | | | |
|---|---|---|---|---|
| 6,257,371 | B1 * | 7/2001 | Wanner | 187/215 |
| 6,302,634 | B1 | 10/2001 | Grenader | |
| 6,345,948 | B1 | 2/2002 | Irish | |

FOREIGN PATENT DOCUMENTS

| | | |
|---|---|---|
| JP | 3110266 | 5/1991 |
| JP | 8028086 | 1/1996 |

OTHER PUBLICATIONS

Applicant Prior Art Publication: "Harding Steel Mechanical Parking Lifts", Harding Steel, Inc., date unknown, p. 1-6.
Applicant Prior Art Publication: "SUV and SUV-XL by Harding Steel", Harding Steel, Inc., date unknown, p. 1-5.
Applicant Prior Art Publication: "Car Lift by Harding Steel", Harding Steel, Inc., date unknown, p. 1-5.
Applicant Prior Art Publication: "Parking Lifts for Private Residences", Harding Steel, Inc., date unknown, p. 1-6.
Applicant Prior Art Publication: "Harding Steel Tri Lift", Harding Steel, Inc., date unknown, p. 1-9.
Applicant Prior Art Publication: "CARPARX Subterranean Vehicle Parking and Storage System", Harding Steel, Inc., date unknown, p. 1-4.
Applicant Prior Art Publication: "CARPARX ST-2 Inground Parking Systems", Harding Steel, Inc., date unknown, p. 1-26.
Applicant Prior Art Publication: "CARPARX Pit Construction Guide", Harding Steel, Inc., date unknown, p. 1-22.
Applicant Prior Art Publication: "CARPARX VTS-1 Two-Level Single-Platform Vehicle Transport System", Harding Steel, Inc., date unknown, p. 1-5.
Applicant Prior Art Publication: "CARMATRIX Multi-Level Semi-Automated Parking System", Harding Steel, Inc., date unknown, p. 1-7.
Applicant Prior Art Publication: "Harding Steel, Inc. Car-Lift Instruction Manual", Harding Steel, Inc., date unknown, p. 1-3.
Applicant Prior Art Publication: "Harding Steel, Inc. SUV and SUV XL Instruction Manual", Harding Steel, Inc., date unknown, p. 1-4.

* cited by examiner

VEHICLE LIFT DEVICE INCLUDING SCISSOR LIFT AND TELESCOPIC UPPER PLATFORM

FIELD OF THE INVENTION

The present invention relates to vehicle parking systems, and more particularly, to a vehicle lift device and method including a scissor lift and a telescopic upper platform that enables vehicles to be selectively moved and stored at two different levels.

BACKGROUND OF THE INVENTION

Multi-story parking structures are used in many urban locations to facilitate the parking of vehicles. Vehicles parked in a multi-level parking structure may have interconnecting driving ramps that allow vehicles to access each of the levels. Alternatively, mechanical elevators may be provided to raise and lower vehicles to the different levels. In many urban locations, elevators are a preferred way to manipulate vehicles between levels since providing driving ramps substantially increases the size of the parking structure and also limits available parking spaces.

While multi-story parking structures are well known in urban locations, it is increasingly popular to also provide multi-level parking structures in residences or small businesses. As the price of land in urban and residential areas continues to become more of a premium, providing multi-level vehicle storage is one simple way in which to reduce the amount of space necessary to park multiple vehicles.

It is well known in the art to provide parking lifts or elevators wherein a load receiving platform receives a vehicle, and the platform is raised or lowered to place the vehicle at the desired level within the parking structure. A number of different types of mechanical lift devices may be used to raise and lower the platform, one known type being a scissor lift.

There are numerous examples of different types of vehicle parking structures that may be used to facilitate the storage of vehicles, and that make use of an elevator or lift to selectively move vehicles from one level to another. Some prior art references disclosing examples of such parking structures include U.S. Pat. Nos. 4,674,938; 5,018,925; 5,024,571; 5,456,562; 6,241,049; 6,302,634; and 6,345,948.

One shortcoming with respect to many prior art references is that use of a single platform in a lift device results in a large gap being present in a higher level of the parking structure once the lift device is lowered. This large gap or hole can present a significant safety concern. Even for those lift devices that may have multiple platforms at different levels, one inherent drawback with even these types of lift devices is that there is still a large gap or hole present when the lift device is moving vehicles from one level to another since the platforms are stationary or fixed in their spacing from one another.

Therefore, there is a need for providing a vehicle lift device that enables vehicles be stored at multiple levels in the parking structure, and provides additional safety to ensure that the gap in the floor of the parking structure that receives the lift device remains exposed only a minimum amount of time when the lift device is being raised or lowered.

There is also a need to provide a vehicle lift device that takes advantage of proven construction in terms of the type of lift device, yet adds the capability for multi-level vehicle storage.

SUMMARY OF THE INVENTION

In accordance with the present invention, a vehicle lift device is provided including a scissor lift assembly and two parking platforms that enable vehicles to be stored at two levels on the lift device or transferred to two levels in a surrounding parking structure. More specifically, the lift device includes a telescopic upper platform and a lower platform. The lower platform is secured to the scissor lift. A plurality of telescoping posts interconnects the upper platform to the lower platform. Each post includes a base or sleeve that telescopically receives a rod or piston. The distance or height between the upper and lower platforms varies depending upon the extent to which the posts are extended or retracted. The telescoping posts retract and extend without any power assist required. To retract, the weight of the upper platform is all that is required. To extend, the upper platform engages an upper level of the parking structure as discussed in detail below.

When the scissor lift is raised such that the lower platform of the device is at the same level as a floor of an upper level of the parking structure, the telescopic upper platform is lowered by retraction of the telescoping posts so that the lift device may fit within the space provided on the upper level of the parking structure.

When the scissor lift is lowered to place the lower platform at the same level as a floor of a lower level of the parking structure, the upper platform in its downward movement will engage the floor of the upper level of the parking structure thereby closing any gap or space in the floor of the upper level that is created by lowering the device. The gap in the floor of the upper level is sized to engage the upper platform such that the upper surface of the upper platform can still be flush with the floor. The telescoping posts extend during downward movement of the lift at which point the upper platform engages the floor of the upper level. In this lowered position, the upper platform of the device may receive for storage another vehicle thereby providing the capability to store or transfer two vehicles at two different levels on the lift device.

When it is desired to raise the vehicle on the lower platform so that it can be moved back to the upper level of the parking structure, a vehicle on the upper platform must first be moved (assuming the ceiling in the upper level has a limiting height), the lift is raised, and the vehicle on the lower platform is again returned to its original position at the upper level of the parking structure. As the scissor lift raises the lower platform, the device reaches a certain height where the telescoping posts become fully retracted and thus any further upward movement causes the upper platform to then rise above the level of the floor of the upper level of the parking structure. As mentioned, the weight of the upper platform causes the telescoping posts to retract, thus no additional force is required to retract the posts.

The ability to service multiple vehicles at different parking structure levels is accomplished with the lift device of the present invention that takes advantage of a reliable scissor lift assembly coupled with the automatic telescoping upper platform.

In other aspect of the invention, it can be considered a combination of the lift device along with elements of a parking structure that are especially adapted to receive the lift device. The upper level gap may define an opening in which a tiered or stepped configuration matingly engages the side edges of the upper platform. Additionally, the floor of the lower level of the parking structure may include a mini-pit or opening sized to receive a carriage support assembly that provides a base support for the scissor lift assembly and the platforms. Thus, in accordance with the present invention, the apparatus of the present invention may include either the vehicle lift device alone, or in combination with features of the parking structure.

Various other features and advantages of the present invention will become apparent from a review of the drawings, taken in conjunction with the detailed description.

DETAILED DESCRIPTION

Figure 1:
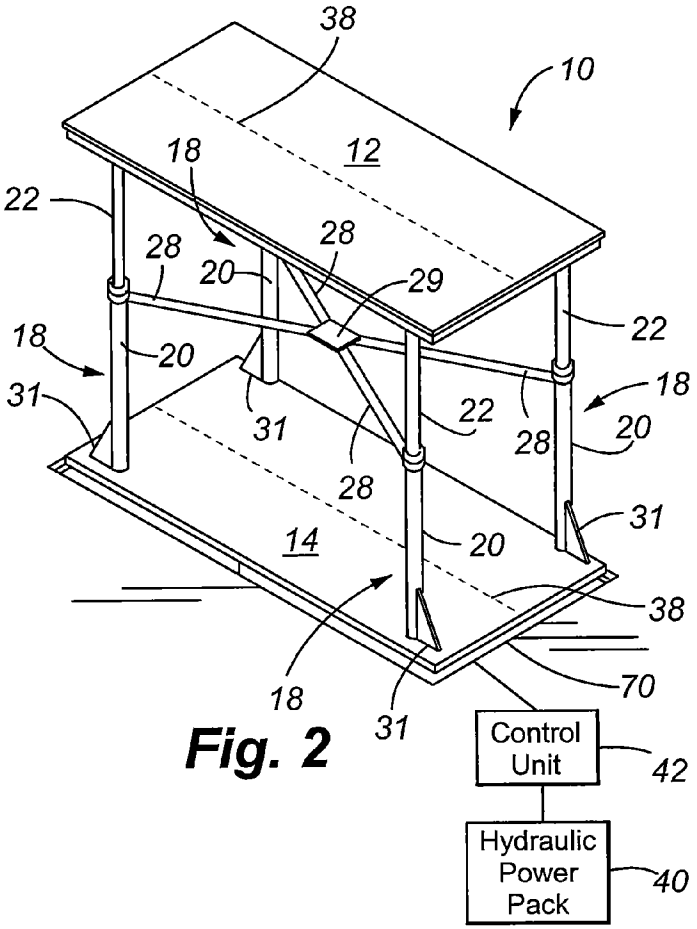
FIG. 1 is a perspective view of the vehicle lift device of the present invention wherein the scissor lift assembly has raised the lower platform, and the upper platform is lowered to accommodate available overhead space in the upper level.

FIG. 1 illustrates the vehicle lift device 10 of the present invention. The vehicle lift device 10 is characterized by a scissor lift assembly 16 that raises and lowers two platforms, namely, an upper platform 12 and a lower platform 14. The lower platform 14 is directly connected to the upper portion of the scissor lift assembly 16. The upper platform 12 is spaced above the lower platform 14 by four telescoping posts 18 positioned at the four corners of the platforms. The telescoping posts 18 each include an outer sleeve 20 and an inner piston or rod 22 that is received in the sleeve. As discussed below, the telescoping posts 18 are operated by the force of gravity and enable the upper and lower platforms to move vertically with respect to one another depending upon the position of the lower platform and whether the upper platform is engaged with the upper level of the parking structure.

The scissor lift assembly 16 includes two pairs of diagonal braces 24 and as shown, each diagonal brace of each pair is arranged in a crossing pattern in which each pair of braces are rotatably connected to one another at pins 26. The upper ends of the diagonal braces are connected to the lower surface of the lower platform 14. A plurality of hydraulic cylinders 30 is used to raise and lower the scissor lift assembly. As shown, a lower cross brace 34 is provided to secure the lower ends of the hydraulic cylinders, and an upper cross brace 32 secures the upper ends of the hydraulic cylinders. Each of the hydraulic cylinders includes a lower sleeve and an upper piston or ram. A hydraulic power pack 40 is shown in schematic and selectively supplies hydraulic fluid to the hydraulic cylinders 30 in order to raise or lower the scissor lift assembly. A control unit 42 controls the hydraulic power pack. The operator interfaces with the control unit in order to selectively raise or lower the scissor lift assembly, thereby raising and lowering the upper and lower platforms. The control unit can interface with the operator in a number of ways to include touch screen controls, wireless control, or a key control. The control unit can selectively raise, lower, or hold the platforms at desired positions. Thus, the control unit may comprise a computer or a programmable logic controller (PLC) that provides output signals to the hydraulic power pack in order to control the exact desired position of the scissor lift assembly. Various interlock or safety switches may be incorporated on the vehicle lift device and can be used as inputs to the computer/PLC in order to ensure that the vehicle lift device is safely operated. One safety feature of the present invention is to ensure that, if there is a loss of power, the hydraulic cylinders 30 do not inadvertently lose pressure, which could otherwise cause the scissor lift assembly to suddenly collapse. The various limit or interlock switches can be incorporated to ensure that the scissor lift assembly is completely controlled in its raised and lower movement.

Figure 3:
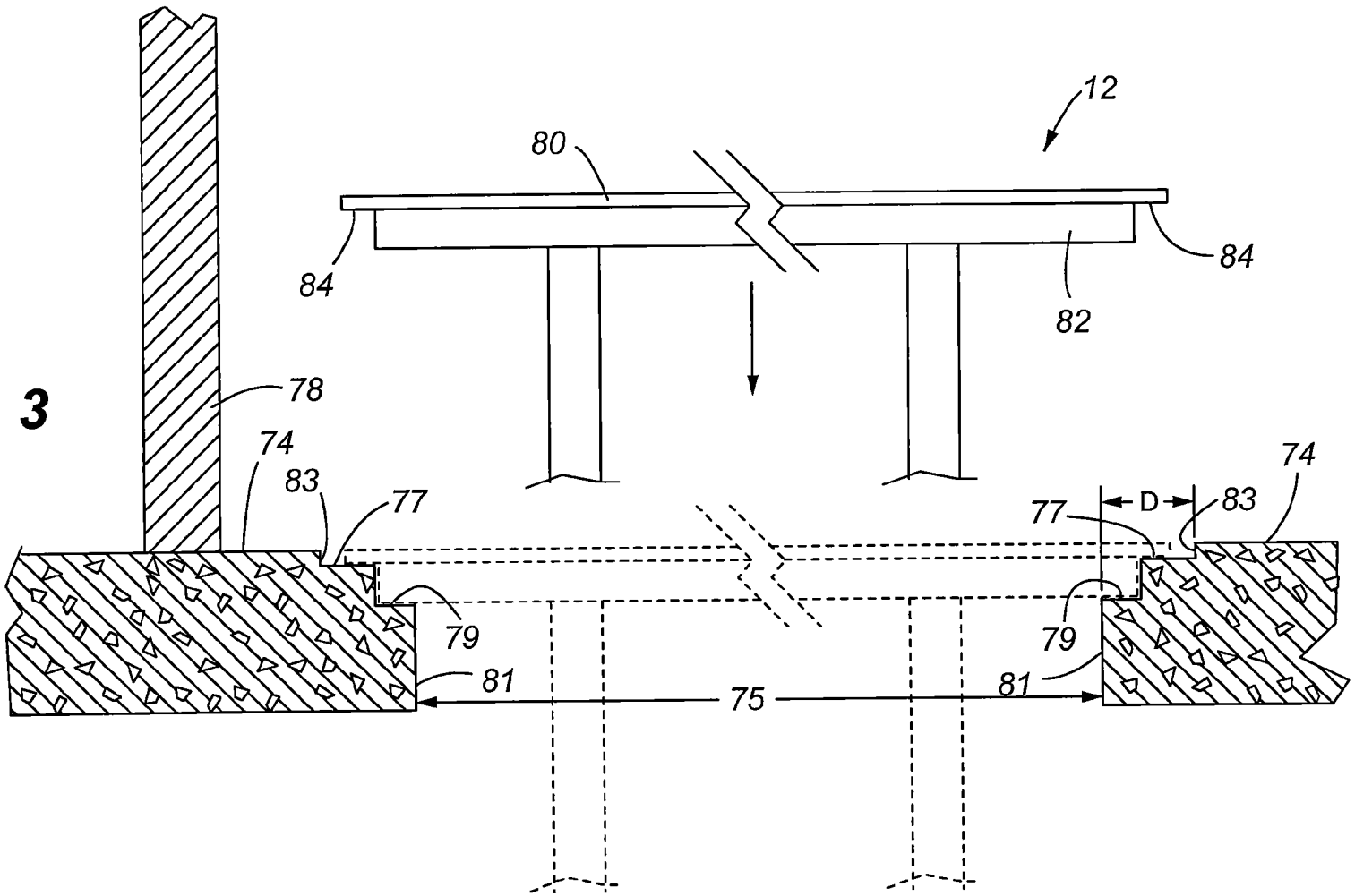
FIG. 3 is an enlarged fragmentary elevation view illustrating the engagement of the upper platform with the floor of the upper level of the parking structure.

The lower ends of the diagonal braces 24 are secured to a base or carriage support assembly 44. Preferably, the carriage support assembly 44 is received in a mini-pit or opening 70 formed in the floor of the lower level. The carriage support assembly includes a pair of spaced and parallel-arranged rails or tracks 46, and a plurality of lateral interconnecting supports 48 that, along with the rails 46, provide a stable base for supporting the scissor lift assembly and platforms. Referring also to FIG. 3, two diagonal braces 24 (one from each pair) have a first pinned or stationary lower end 50 that remains secured to the carriage support assembly. The other two diagonal braces each include a lower end 52 that is secured to a respective rail, but slides or rolls along the rail 46 enabling the scissor lift to raise or lower. The lower ends 52 may include rollers or sliding mechanisms (not shown) that enable the lower ends 52 to easily slide or roll along the rails 46 based upon the state of the hydraulic cylinders 30 which raise or lower the scissor lift assembly 16. Thus, when the scissor lift assembly is in the raised position as shown in FIG. 4, the ends 52 are at position A on the rails 46, but when lowered, the ends 52 slide or roll along the rails 46 such that the ends 52 are located at position B.

Figure 2:
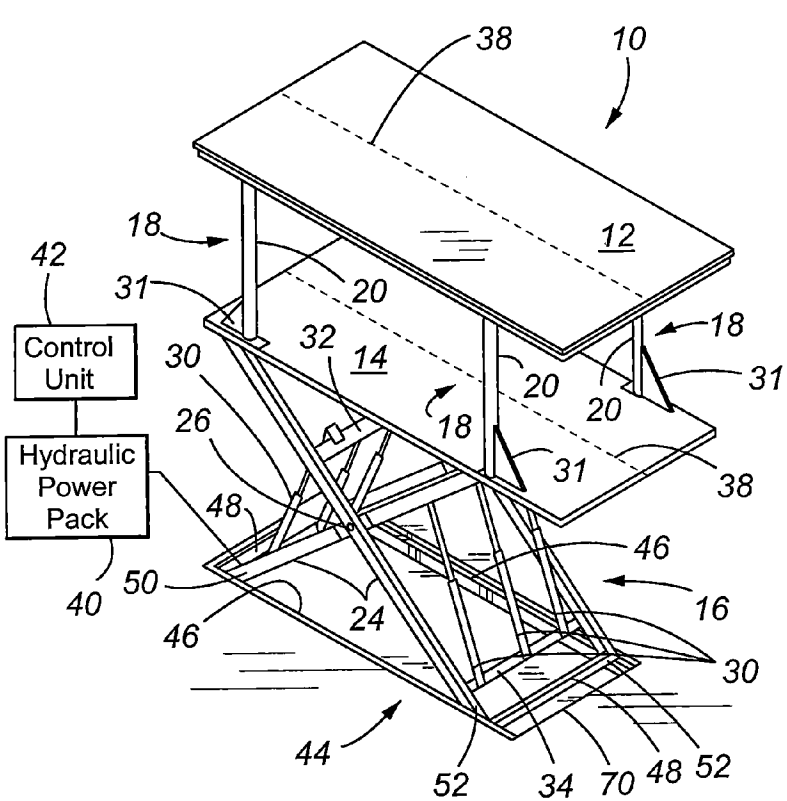
FIG. 2 is another perspective view of the vehicle lift device of the present invention illustrating the scissor lift lowered, and the telescoping posts extended such as occurs when upper platform engages the floor of the upper level of the parking structure during downward movement of the scissor lift.

Referring to FIG. 2, the scissor lift assembly is shown in the lowered position and the upper platform is spaced farther apart from the lower platform by the telescoping posts 18 being extended. In this extended configuration, a plurality of horizontal braces 28 is visible which provide stiffening support between the upper and lower platforms. The braces 28 are mounted between the platforms and preferably just below the lower surface of the upper platform. As shown, the horizontal braces or supports 28 are provided in a diagonal pattern and are connected in a central region by connecting plate 29. To provide yet further structural support to the telescoping posts, the lower end of each sleeve 20 is connected to a support plate 31 that helps to stabilize the connection between the lower platform and the sleeves 20. As also shown in FIGS. 1 and 2, an optional centerline 38 may be painted on the upper and lower platforms in order to guide a vehicle operator in centering vehicles over the respective platforms.

Figure 4:
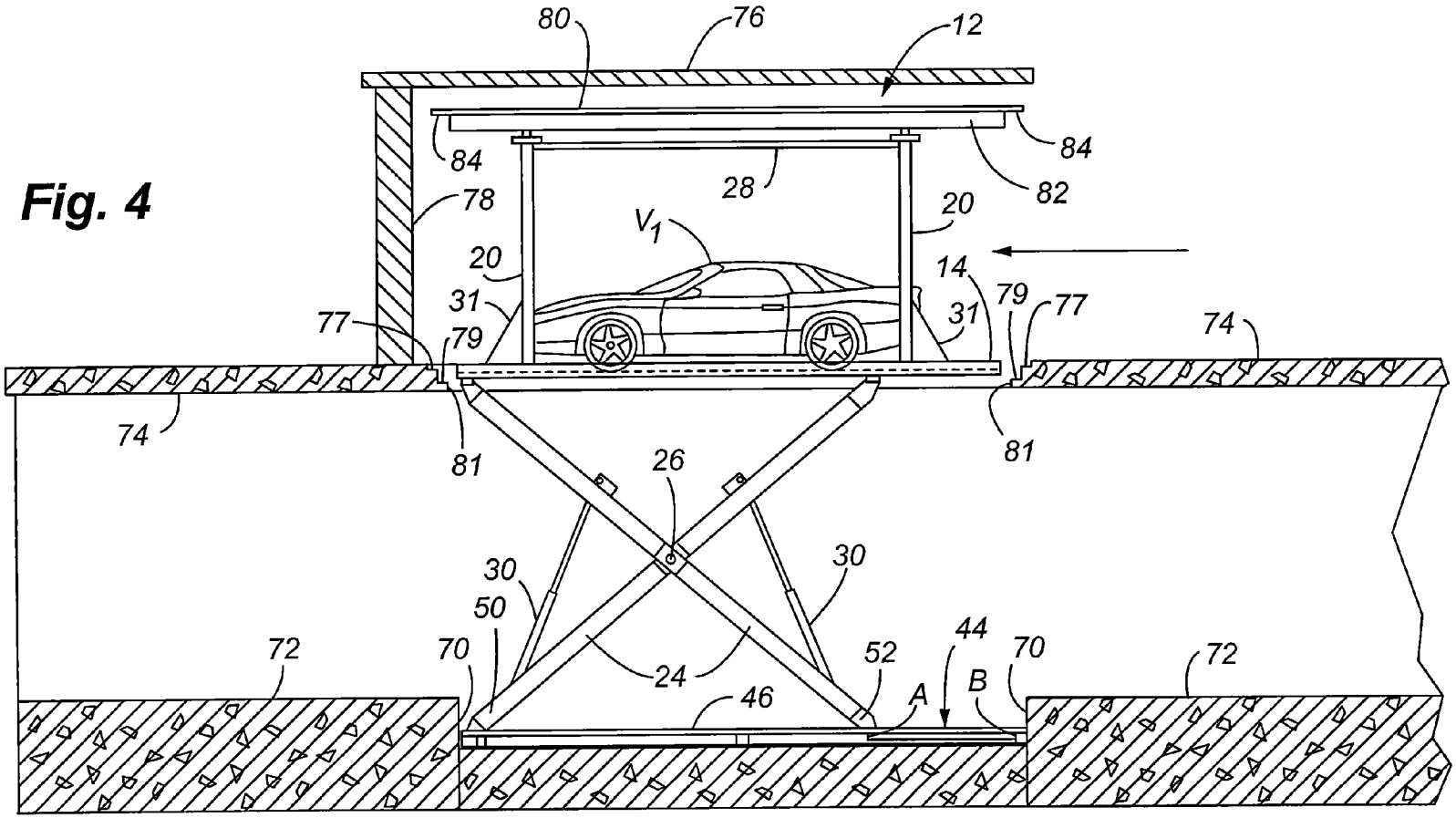
FIG. 4 is an elevation view of the lift device of the present invention illustrating the scissor lift assembly raised thereby placing the lower platform at the upper level of the parking structure, the upper platform being lowered, and the lower platform receiving a first vehicle.

Referring now to FIGS. 3 and 4, additional details are provided for illustrating the manner in which the upper platform 12 engages the floor 74 of the upper level of the parking structure. As shown in FIG. 4, the parking structure is defined as the building that houses the vehicle lift device 10 and vehicles to be parked. The parking structure includes a lower level defined by floor 72 having the mini-pit or opening 70 that receives the carriage support assembly 44. The upper or second level of the parking structure is defined by the upper floor 74. One or more walls 78 may define the exterior or interior walls of the parking structure. A ceiling 76 defines the roof or most upper portion of the parking structure. The vehicle lift device is raised and lowered between the upper and lower levels of the parking structure. When the vehicle lift device is lowered, the upper platform 12 engages the upper floor 74 of the upper level. The size of the opening in the parking apparatus is sized to fit the upper platform such that a secured mating engagement is achieved when the scissor lift assembly is lowered and the upper platform thereby makes contact with the floor 74. Referring to FIG. 3, the upper platform includes an upper deck or treadway 80 and a lower support 82. The upper deck or treadway 80 is greater in length than the lower support 82 such that respective overhangs 84 are created at both ends of the platform. The floor 74 of the upper level includes the central opening or gap 75. Each side of the upper level of floor 74 defining the gap or opening 75 has a pair of stepped flanges or recesses 77 and 79 that are sized to mate with overhangs 84 of the upper platform 12. As shown, when the upper platform is level or flush with the upper floor 74, the lower edge of the support 82 rests on lower recess 77, while the lower edge of overhang 84 rests on recess 77. Thus, any load applied to the upper platform in this position is distributed to the upper floor 74. It is noted that the lower platform is preferably of a length that is slightly less than the length of the upper platform, considering that in order for the lower platform to be placed flush with the upper floor 74, the lower platform must clear the gap 75. Therefore, referring again to FIG. 3, the most exterior edges of the lower platform must clear the internal facing edges 81 of the gap 75. Preferably, the lower platform when raised is flush with the floor 74 and, therefore, there is only a small gap between the most external edges of the lower platform and the upper facing edges 83 adjacent the recesses 77. In the preferred embodiment, the distance between edges 81 and 83 is minimal. Therefore, when the lower platform is raised to the upper level floor 74, a vehicle operator moving the vehicle will not experience a significant bump or shift of the lift device as the vehicle is driven off the lower platform. In any event, the thickness of the lower platform is such that lower portions of the exterior edges of the lower platform abut facing edges 81 of the gap 75 and, therefore, there is very little lateral shifting or movement of the lift device when the lower platform is raised and vehicles are being loaded or off-loaded.

Referring to FIG. 4, the operation of the present invention will be explained in accordance with the method of the present invention. In FIG. 4, the vehicle lift device is shown in the raised position wherein the lower platform 14 is flush with the floor 74 of the upper level. The upper platform 12 is lowered and, therefore, there is some clearance between the ceiling 76 and the upper platform 12. A first vehicle has entered the parking garage and the vehicle is parked on the lower platform 14.

Figure 5:
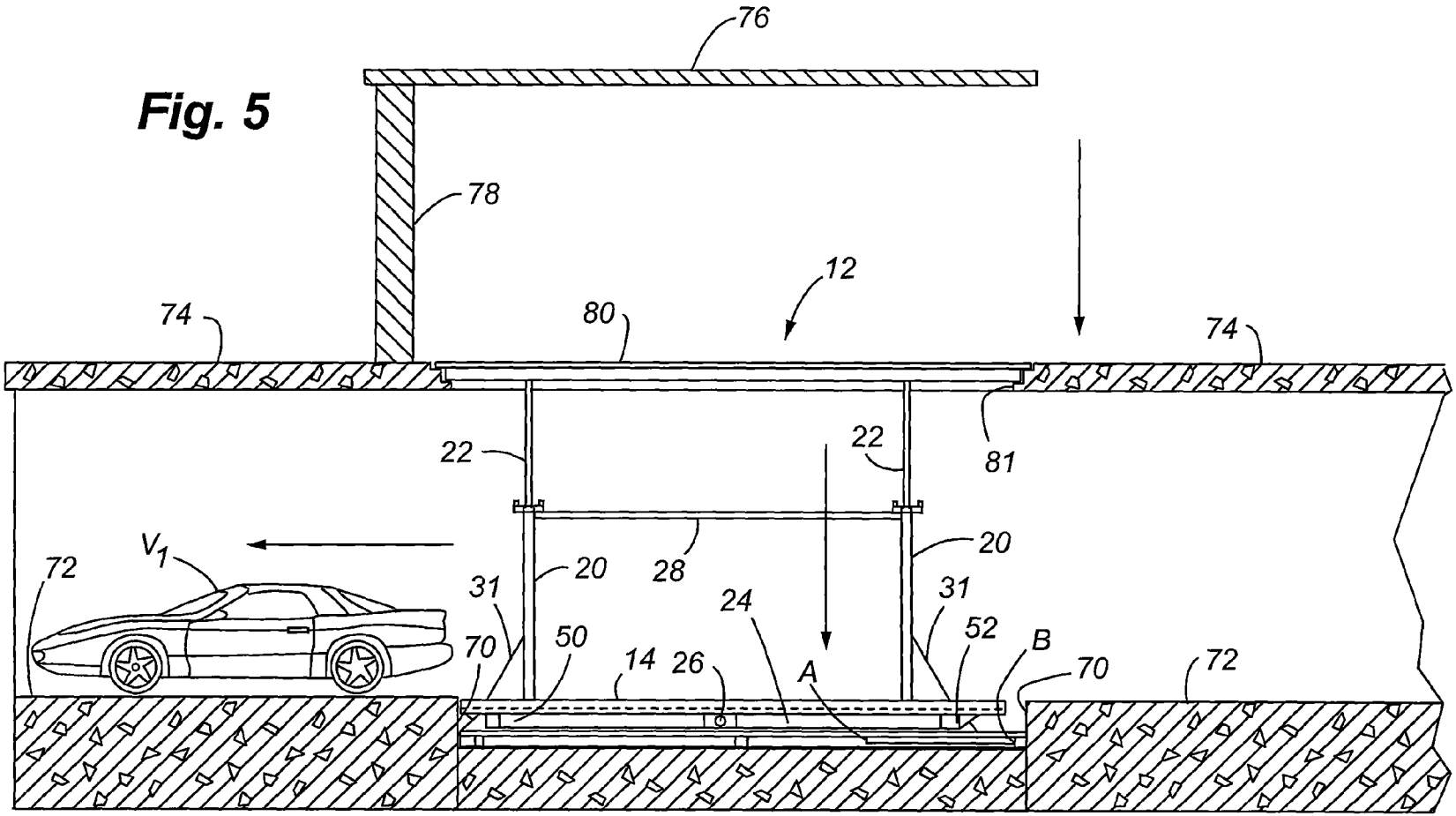
FIG. 5 is another elevation view of the lift device of the present invention illustrating the scissor lift assembly lowered thereby moving the lower platform to a lower level of the parking structure, and further illustrating the upper platform engaged with the floor of the upper level of the parking structure thereby telescoping the upper platform with respect to the lower platform; this Figure further illustrates the first vehicle parked at the lower level but moved off the lower platform.

Now referring to FIG. 5, the scissor lift assembly is operated such that it has been lowered, and the lower platform 14 is flush with the floor 72 of the lower level. When the upper platform 12 engages the floor 74, the rod or pistons 22 of the telescoping posts 18 extend as the lower platform continues to lower, thus minimizing the time in which there is any gap or opening in the upper floor of the parking structure. If no telescoping posts were used and the upper platform was fixed in its spacing from the lower platform, then presumably the amount of time in which the gap was exposed would increase since the upper platform would not reach its flush position with the upper level of the structure until the lower platform was fully lowered. In the example of FIG. 5, the vehicle is then driven off the lower platform and stored at a parking spot within the lower level of the parking structure.

Figure 6:
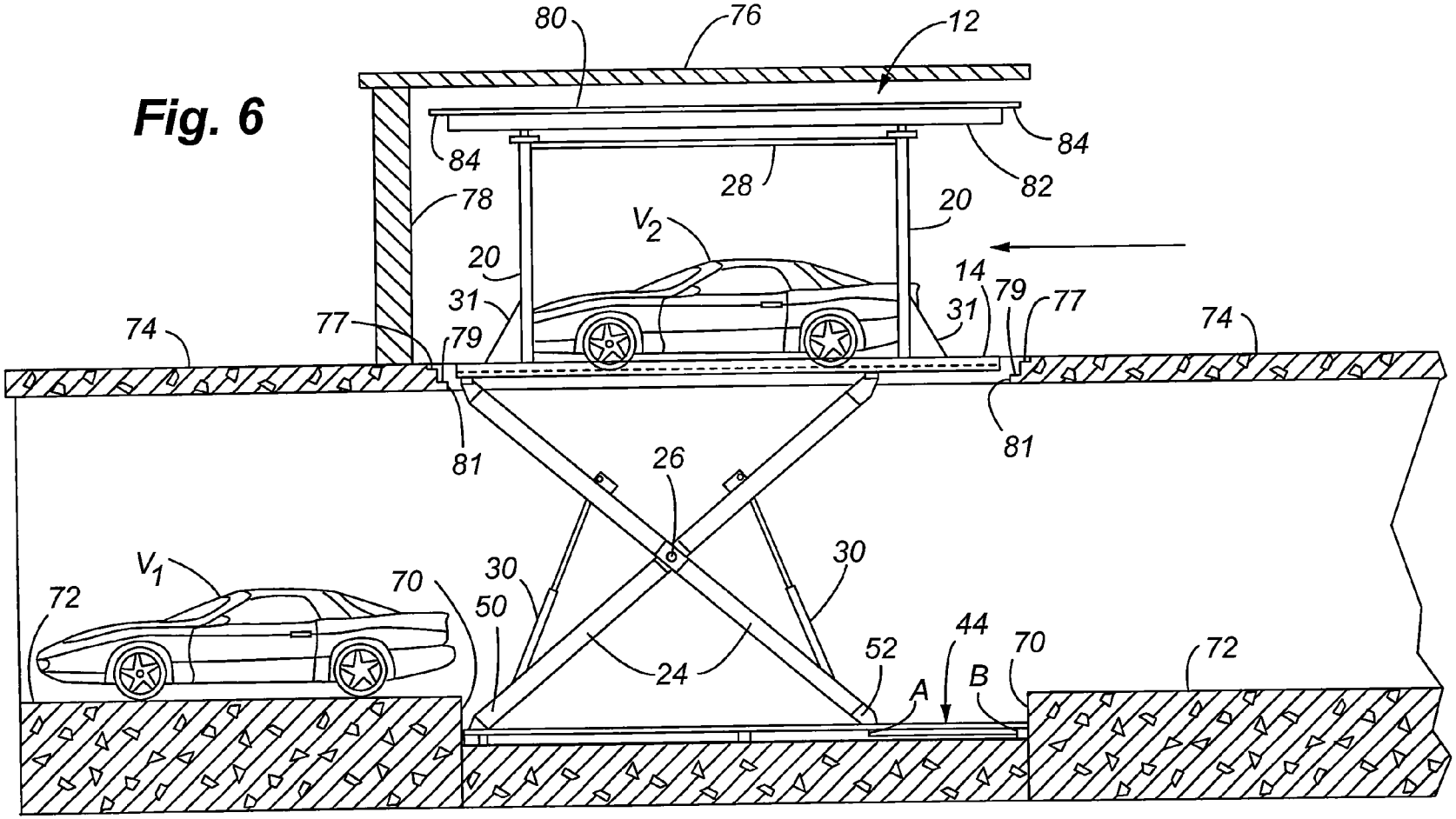
FIG. 6 is another elevation view of the lift device of the present invention illustrating the scissor assembly raised again like in FIG. 4 wherein a second vehicle is parked on the lower platform.

Referring to FIG. 6, the scissor lift assembly has been raised again, and a second vehicle is driven onto the lower platform 14.

Figure 7:
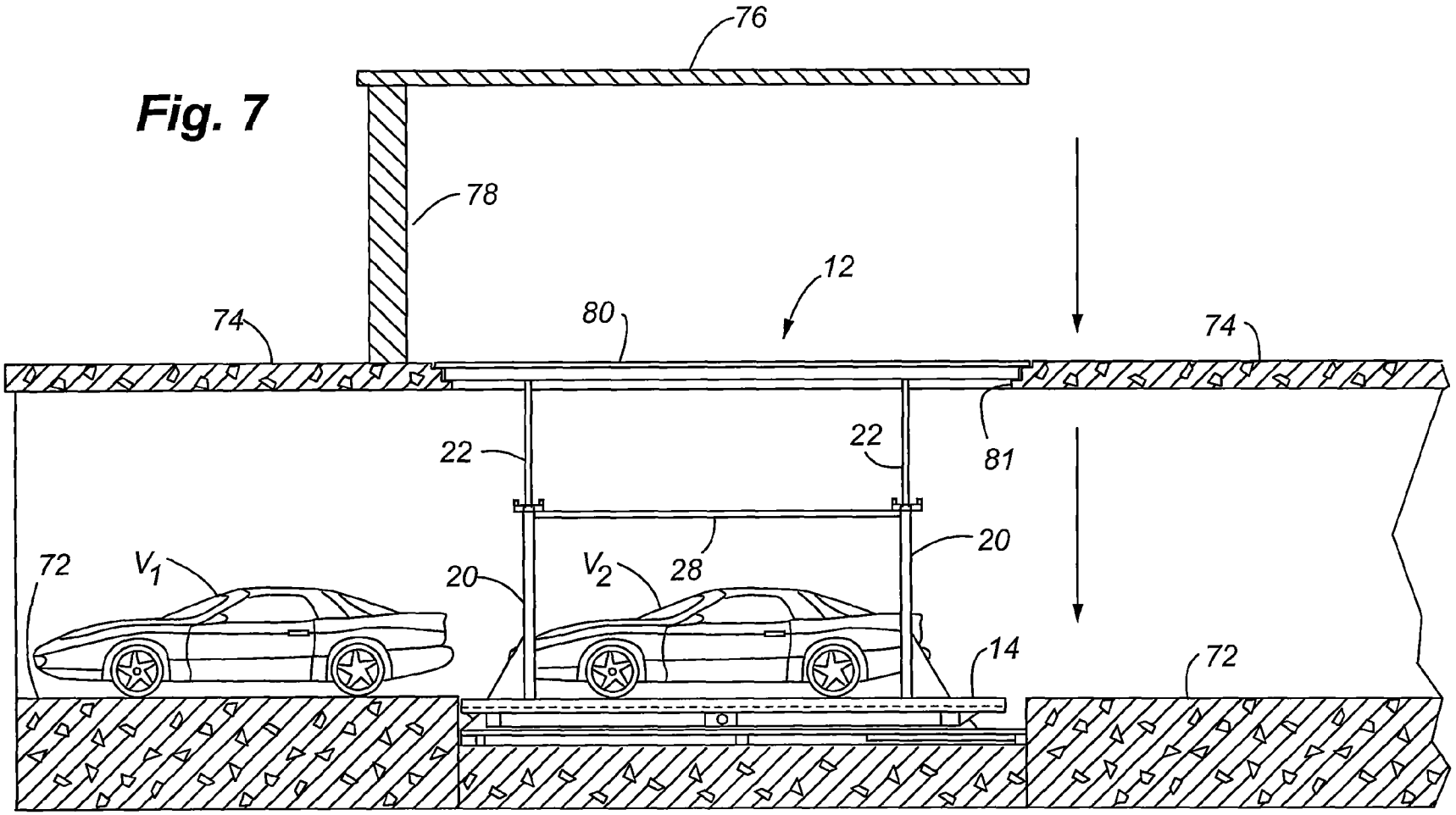
FIG. 7 is another elevation view showing the scissor lift lowered like in FIG. 5, and showing the second vehicle now located at the lower level of the parking structure with the first vehicle.

Referring to FIG. 7, the scissor lift assembly is again lowered and the upper platform has engaged the floor of the upper level.

Figure 8:
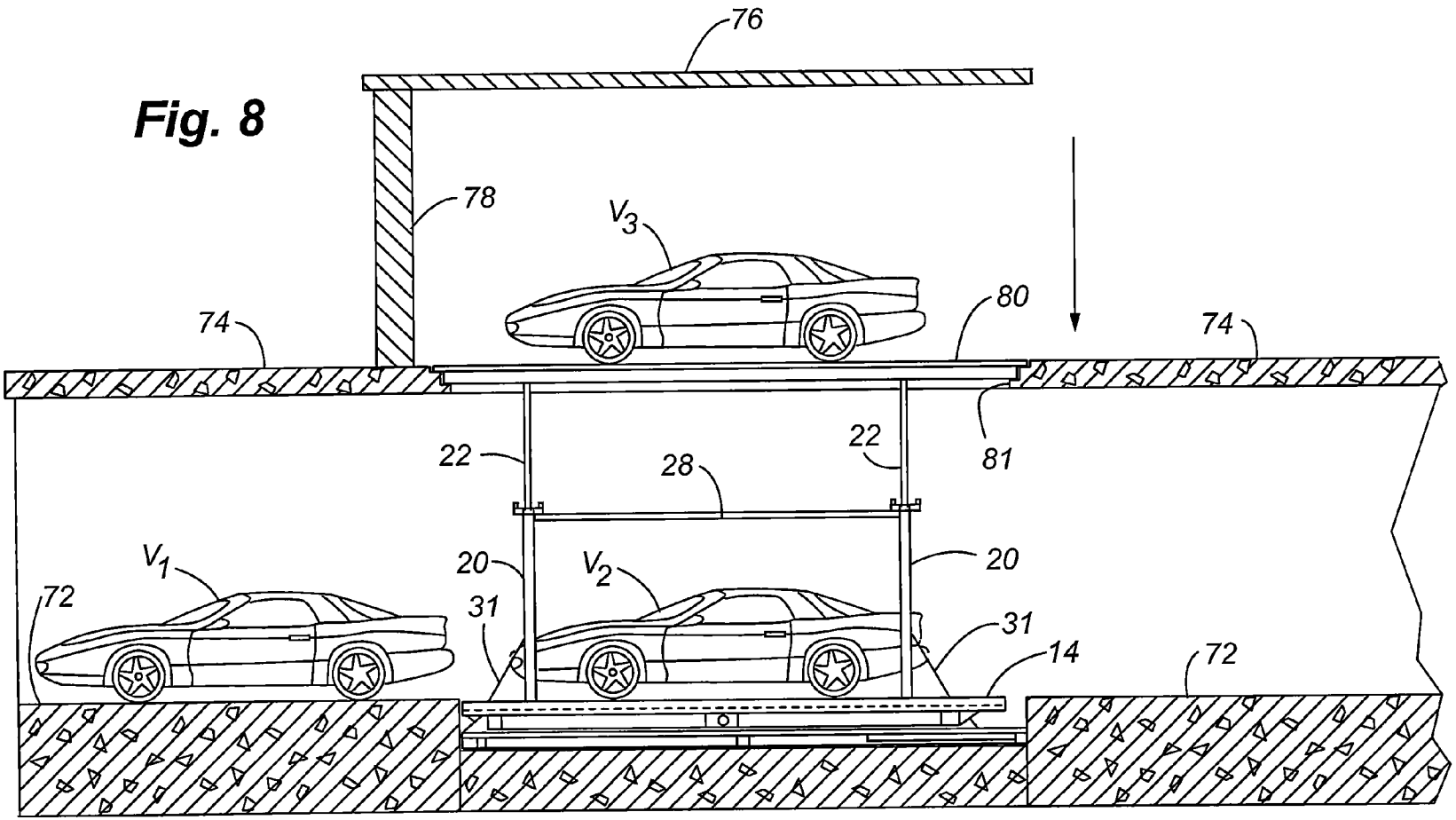
FIG. 8 is the elevation view of FIG. 7 but illustrating a third vehicle now parked on the upper platform of the lift device.

Referring to FIG. 8, a third vehicle is then driven on the upper platform. Thus, two vehicles are parked on the vehicle lift device.

When the vehicle lift device moves to the raised position as shown in FIG. 4 and 6, the telescoping posts collapse by the pistons/rods 22 lowering into their respective sleeves 20. Preferably, a close tolerance fit is provided between the rods 22 and the sleeves 20 such that there is a smooth and even retraction of the rods 22 within the sleeve without any appreciable lateral shifting of the rods. When the rods are fully retracted within the sleeves, the lower surface of the upper platform rests on the most upper surfaces of the sleeves. These upper surfaces of the sleeves may be equipped with cushions or pads that prevent metal-to-metal contact between the lower surface of the platform and the sleeves.

The rate of lift or rise of the lower platform by operation of the scissor lift assembly is such that this rate does not exceed the rate at which the rods 22 can smoothly retract within the sleeves 20. Therefore, the gap in the upper floor of the parking apparatus remains covered by the upper platform 12 until the rods 22 have been fully retracted within the sleeves 20. As the scissor lift continues to rise, the upper platform finally separates from engagement with the floor of the upper level.

One great advantage of incorporating the telescoping posts of the vehicle lift device of the present invention is that no separate hydraulic power is required to operate the positioning of the upper platform and, rather, it is simply the weight of the upper platform that causes the rods 22 to retract within the respective sleeves 20. The telescoping feature of the upper platform adds safety since there is but a very small timeframe in which the opening in the upper floor is not covered by the upper or lower platform; if the platforms were simply interconnected by non-telescoping posts, the space or height between the platforms would always be fixed and thus the opening would remain uncovered until the lift was placed either in its fully raised or lowered position. Additionally, the lift device of the present invention is more adaptable to be installed in parking structures having different heights between parking levels since the telescoping posts allow automatic adjustment of the height between the upper and lower platforms.

The vertically stacked arrangement of two vehicles that may be parked on the vehicle lift device maximizes space efficiency in the parking structure in which it is installed. The in-ground or in-pit installation of the carriage support assembly enables the lower platform to be placed flush with the lower level of the parking structure, thereby enabling easy offloading of a vehicle onto the lower level.

If the particular parking structure has a ceiling with a high enough clearance, two vehicles may be simultaneously raised. More specifically, if the ceiling is high enough in the particular parking structure and a vehicle is already parked on the upper platform, a vehicle parked on the lower platform may be raised to the second level of the parking structure without having to remove the vehicle parked on the upper platform.

As mentioned above, one safety feature that may be incorporated within the control unit is a "dead-man" feature that stops the movement of the scissor lift whenever an up or down control is released or there is a loss of power, regardless of the position of the lift at the time the control is released. Also, for safety, the operator switches are preferably placed within full line of sight of the lift device, but not so close so as to place the operator in a location where the operator can inadvertently place hands or feet on or under the platforms during operation. An upper limit switch may be provided to stop the lift to set an upper limit where the lower platform meets the grade level of the upper level. Similarly, a lower limit switch may be provided to stop the lift to set a lower limit where the lower platform meets the grade level of the lower level.

Although the present invention has been described below with respect to one ore more preferred embodiments, it shall be understood that various other changes and modifications to the invention may be made within the spirit and scope of the invention, and in accordance with the scope of the claims appended hereto.

What is claimed is:

1. A vehicle lift device comprising:

a carriage support assembly including a pair of rails spaced apart from one another and extending substantially parallel to one another;

a lift assembly including a plurality of diagonally extending braces, said braces having upper first ends, and lower second ends connected to said carriage support assembly;

at least one hydraulic cylinder coupled with a hydraulic power pack for operating said lift assembly;

a lower platform connected to the upper ends of said diagonal braces;

an upper platform located above the lower platform; and a plurality of telescoping posts interconnecting said lower platform to said upper platform, each telescoping post including a sleeve that remains fixed to said lower platform, and a rod having a lower end received in said sleeve, and said rod having an upper end connected to said upper platform; and wherein said telescoping posts are unpowered, said telescoping posts being lowered by gravity and being extended by contact with an upper floor surface.

2. A vehicle lift device, as claimed in claim 1, wherein said at least one hydraulic cylinder operates said braces to simultaneously raise said lower and upper platforms, said lift device being operable between a lowered position wherein said lower platform is placed flush with a lower level of a parking structure, and a raised position wherein said lower platform is placed flush with an upper level of the parking structure.

3. A vehicle lift device, as claimed in claim 1, wherein:

two diagonal braces of said plurality of diagonal braces have lower ends that are engaged and moveable along said pair of spaced rails when said lift device is moved between the lowered position and the raised position.

4. A vehicle lift device, as claimed in claim 1, wherein:

said upper platform is arranged vertically over said lower platform.

5. A vehicle lift device, as claimed in claim 1, wherein:

said telescoping posts are placed at respective corners of said upper and lower platforms, said platforms each having a substantially rectangular shape.

6. A vehicle lift device, as claimed in claim 1, wherein:

said carriage support assembly is received within a pit formed on a lower level of a parking structure such that when said lift device is placed in the lowered position, said lower platform is substantially flush with a floor surface of the lower level of the parking structure thereby covering the carriage support assembly.

7. A vehicle lift device, as claimed in claim 1, further including:

the hydraulic power pack communicating with a control unit for control of said vehicle lift device to place said vehicle lift device selectively between the raised and lowered positions.

8. A vehicle lift device, as claimed in claim 1, further including:

a plurality of horizontal braces secured to said telescoping posts for stabilizing the connection between the upper and lower platforms.

9. A vehicle lift device, as claimed in claim 1, wherein:

said upper platform includes a deck, a lower support connected to said deck, and wherein said deck has a length that is longer than the length of the lower support thereby creating a pair of overhangs located at opposite ends of said deck.

10. A method of positioning vehicles in a parking structure, said method comprising steps of:

providing a vehicle lift device including an upper platform, a lower platform, a plurality of telescoping posts interconnecting said upper and lower platforms, a lift assembly connected to said lower platform for selectively raising and lowering said upper and lower platforms, and a hydraulic power pack for operating said lift assembly;

positioning the lift device within the parking structure such that the lower platform is placed flush with an upper level of said parking structure and said upper platform is disposed above said lower platform;

placing a vehicle on said lower platform;

lowering the lift device so that the lower platform is lowered flush with a lower level of the parking structure; and contacting the upper platform with the upper level of the parking; and extending the telescoping posts interconnecting the upper and lower platforms; and wherein said telescoping posts are unpowered, said telescoping posts being lowered by gravity and being extended by contact with an upper floor surface.

11. A method, as claimed in claim 10, further including the step of:

raising the lift device wherein the telescoping posts retract by the weight of the upper platform on the telescoping posts and without communication with said hydraulic power pack;

continuing to raise the vehicle lift device such that the upper platform is forced above the upper level of the parking structure when the telescoping posts are fully retracted;

continuing to raise the vehicle lift device such that the lower platform is placed flush with the upper level of the parking structure.

12. In combination, a vehicle lift device and parking structure comprising:

(a) a parking structure including:

(i) a first lower level;

(ii) a second upper level placed above said lower level;

(iii) a pit formed in said first lower level; and (iv) an opening formed in said second upper level;

(b) a lift device including:

a carriage support assembly placed in said pit;

(ii) a lower platform;

(iii) a scissor lift assembly placed between and interconnecting said lower platform and said carriage support assembly, said lift assembly including a hydraulic power pack;

(iv) an upper platform; and (iv) a plurality of telescoping posts placed between and interconnecting said upper and lower platforms, each telescoping post including a sleeve connected to said lower platform, and a rod having a lower end received in said lower sleeve and said rod having an upper end connected to said upper platform; and wherein said telescoping posts are unpowered, said telescoping posts being lowered by gravity and being extended by contact with an upper floor surface.

13. A vehicle lift device comprising:

a lift assembly including a plurality of braces selectively operable between a raised position and a lowered position, and a hydraulic power source for operating said lift assembly;

a lower platform connected to said lift assembly;

an upper platform located above the lower platform; and a plurality of telescoping posts interconnecting said lower platform to said upper platform, each telescoping post including a sleeve that remains fixed to said lower platform, and a rod having a lower end received in said sleeve, said rod having an upper end connected to said upper platform; and wherein said telescoping posts are unpowered, said telescoping posts being lowered by gravity and being extended by contact with an upper floor surface.

14. A vehicle lift device, as claimed in claim 13, further including:

a carriage support assembly including a pair of rails spaced apart from one another and extending substantially parallel to one another; and wherein said lift assembly includes said braces having upper first ends connected to said lower platform, and lower second ends connected to said carriage support assembly.

15. A vehicle lift device, as claimed in claim 13, wherein:

said telescoping posts are placed at respective corners of said upper and lower platforms.

* * * * *